US005270688A

United States Patent [19]

Dawson et al.

[11] Patent Number: 5,270,688

[45] Date of Patent: Dec. 14, 1993

[54] APPARATUS FOR GENERATING A CURSOR OR OTHER OVERLAY WHICH CONTRASTS WITH THE BACKGROUND ON A COMPUTER OUTPUT DISPLAY

[75] Inventors: William Dawson, Sunnyvale; Dean Drako, Cupertino, both of Calif.

[73] Assignee: Apple Computer, Inc., Cupertino, Calif.

[21] Appl. No.: 951,345

[22] Filed: Sep. 25, 1992

Related U.S. Application Data

[63] Continuation of Ser. No. 626,675, Dec. 12, 1990, abandoned.

[51] Int. Cl.[5] ..... G09G 1/28

[52] U.S. Cl. ..... 345/150; 345/145; 345/147

[58] Field of Search ..... 340/703, 728, 793, 721

[56] References Cited

U.S. PATENT DOCUMENTS

| | | | |
|---|---|---|---|
| 4,704,605 | 11/1987 | Edelson | 340/728 |
| 4,734,619 | 3/1988 | Havel | 340/703 |
| 4,837,562 | 6/1989 | Nishiura et al. | 340/728 |
| 4,895,376 | 1/1990 | Chiang Shiung-Fri | 340/727 |
| 4,977,398 | 12/1990 | Pleva et al. | 340/793 |

*Primary Examiner*—Ulysses Weldon
*Assistant Examiner*—Matthew Luu
*Attorney, Agent, or Firm*—Blakely, Sokoloff, Taylor & Zafman

[57] ABSTRACT

A circuit for generating pixel values for an overlay for a bitmapped output display including apparatus for testing the color value of a background pixel, apparatus for setting the color value of the pixel of the overlay to a minimum value for the particular color if the color value of a background pixel is greater than a preselected value, and apparatus for setting the color value of the pixel of the overlay to a maximum value for the particular color if the color value of a background pixel is less than the preselected value.

21 Claims, 5 Drawing Sheets

| OVERLAY ACTIVE | PIXEL CURSOR (Pc) | MASK BIT | A A[1:0] | $M_0$ (47) | $M_1$ (48) | $M_2$ (49) | DESTINATION PIXEL | DESCRIPTION |
|---|---|---|---|---|---|---|---|---|
| 0 | XX | X | XX | Pb | Pb | Pb | Pb | Cursor Overlay Disabled |
| 1 | White | 0 | XX | Pb | Pb | Pb | Pb | Transparent |
| 1 | !White | 0 | 00 | Pb | Pc' | Pb | .25 Pth + .75 Pb | |
| 1 | !White | 0 | 01 | Pc' | Pc' | Pb | .50 Pth + .50 Pb | Antialiased Pth Cursor |
| 1 | !White | 0 | 10 | Pb | Pc' | Pc' | .75 Pth + .25 Pb | |
| 1 | !White | 0 | 11 | Pc' | Pc' | Pc' | Pth | Opaque Pth Cursor |
| 1 | XX | 1 | 00 | Pb | Pc' | Pb | .25 Pc + .75 Pb | |
| 1 | XX | 1 | 01 | Pc' | Pc' | Pb | .50 Pc + .50 Pb | Antialiased Cursor |
| 1 | XX | 1 | 10 | Pb | Pc' | Pc' | .75 Pc + .25 Pb | |
| 1 | XX | 1 | 11 | Pc' | Pc' | Pc' | Pc | Opaque Cursor |

FIGURE 5

APPARATUS FOR GENERATING A CURSOR OR OTHER OVERLAY WHICH CONTRASTS WITH THE BACKGROUND ON A COMPUTER OUTPUT DISPLAY

This is a continuation of application Ser. No. 07/626,675, filed Dec. 12 1990, now abandoned.

BACKGROUND OF THE INVENTION

1. Field of the Invention

This invention relates to computer circuitry and, more particularly, to methods and apparatus for generating a cursor or other overlay which is clearly distinguishable from the background picture being displayed on a computer output display.

2. History of the Prior Art

In order to facilitate the use of computers, the use of bitmapped graphics displays and pointing devices has become prevalent. A pointing device, such as a mouse, provides input signals to control precisely the position of a cursor on the output display to enable some action to take place at the position. With a simple black and white display, the position of the cursor may be easily discerned by the operator if a line of pixels surrounding the cursor is of opposite color value to the cursor. Thus, if the background is black and the cursor black, a thin white line surrounding the cursor allows the cursor to be easily discerned. If the cursor is black and the background is white, the thin white line of pixels merges with the background and disappears, but the cursor remains easily discernible.

A more difficult problem arises where the thin line may not be placed around the cursor for any of various reasons such as the shape or type of the particular cursor. In such a situation, in order to discern the overlay, it is typical to render the overlay in a color which contrasts with the background pixels.

With a black and white display it is typical to obtain a color value for the cursor which contrasts with the background by simply inverting the signal defining the background color at each particular pixel position; for example, if a zero binary value indicates white and a one indicates black, inverting either value produces the opposite value. However, if the output display is not a simple black and white display but a gray scale display, providing a discernible cursor (or other overlay) is more difficult. The shades of gray of pixels (often referred to herein as color values) produced on a gray scale monitor are typically indicated by a code of eight bits (one byte). An inversion of these values does not necessarily produce a shade of gray which is discernible from the background. For example, if the typical digital code indicating a middle shade of gray (i.e., 0111 1111) is inverted, a shade (i.e., 1000 0000) immediately adjacent that initial shade is produced, a shade barely discernible from the initial shade. A similar problem exists in attempting to produce discernible overlays for color displays where eight bits of binary information are used to define each of the red, green and blue components producing the color of the pixel.

Another problem encountered in attempting to discern a cursor from the background relates to the ability to describe accurately the shape of the cursor where its size is quite small with respect to the number of pixels used. The small size of the cursor makes its display much more subject to the jagged edges typical of diagonal lines on an output display of low resolution. To date no arrangement for solving this problem has been found for display overlays.

SUMMARY OF THE INVENTION

It is, therefore, an object of the present invention to provide an arrangement for generating cursors or other overlays for computer output displays which overlays are easily discernible from the background over which they are displayed.

It is another more specific object of the present invention to provide an arrangement for generating cursors or other overlays for computer output displays which contrast with the background by easily discernible amounts.

These and other objects of the present invention are realized in a circuit for generating pixel values for an overlay for a bitmapped output display comprising means for testing the color value of a background pixel, means for setting the color value of the pixel of the overlay to a minimum value for the particular color if the color value of a background pixel is greater than a preselected value, and means for setting the color value of the pixel of the overlay to minimum value for the particular color if the color value of a background pixel is less than the preselected value.

These and other objects and features of the invention will be better understood by reference to the detailed description which follows taken together with the drawings in which like elements are referred to by like designations throughout the several views.

BRIEF DESCRIPTION OF THE DRAWINGS

FIG. 5 is a diagram illustrating various signals used in the operation of the circuit of FIG. 4.

NOTATION AND NOMENCLATURE

Some portions of the detailed descriptions which follows are presented in terms of representations of operations on data bits within a computer memory. These descriptions and representations are the means used by those skilled in the data processing arts to most effectively convey the substance of their work to others skilled in the art. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most case in any of the operations described herein which form part of the present invention; the operations are machine operations. In all cases the distinction between the method operations in operating a computer and the method of computation itself should be borne in mind. The present invention relates to apparatus for operating a computer in processing electrical or other (e.g. mechanical, chemical) physical signals to generate other desired physical signals.

Figure 1:
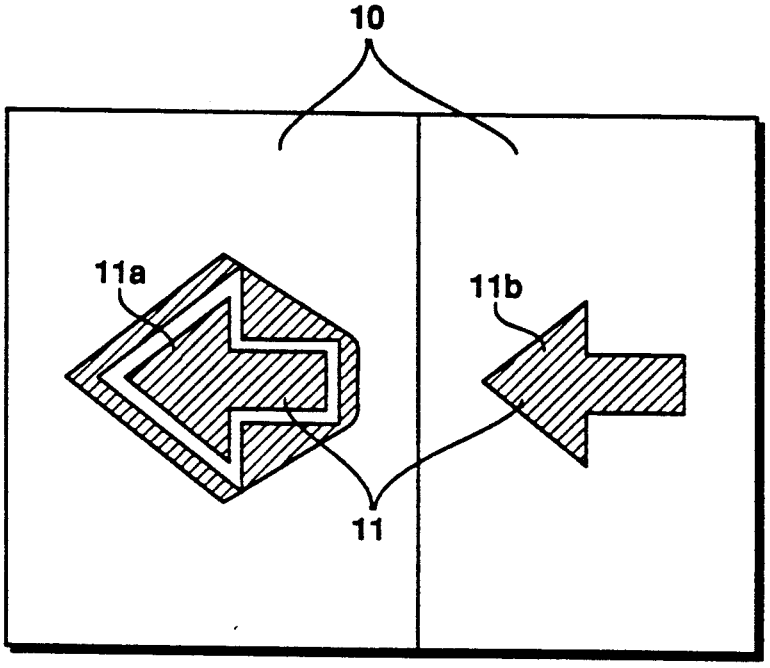
FIG. 1 is a diagram illustrating a pair of cursors positioned against different background colors.

Referring now to FIG. 1 there are shown two detailed areas of a computer output display 10 upon which a graphics output may be presented. Illustrated on each detailed area of the display 10 is a cursor 11 in the shape of an arrow. The cursor 11 is shown in a first position 11(*a*) and a second position 11(*b*). The cursor in the position 11(*a*) is arranged against a black background while the cursor in the position 11(*b*) is arranged against a white background. The cursor in the position 11(*a*) is separated from the background by a thin line of pixels which are white and clearly distinguish the black central portion of the cursor from the black background. Although the same thin white line surrounds the cursor 11(*b*) to the right in the figure, the thin white line is merged with the white background. Even so, the cursor 11(*b*) is clearly separated from the background by the fact that its color is black.

A more difficult problem is presented by a cursor which is of a form for which a surrounding line is not appropriate. For example, certain cursors used for inserting text or clearly distinguishing positions have a form similar to a capital I or to a cross; to add a surrounding line detracts from their form and accurate use. The typical method of separating such a cursor from the background is to render the cursor in a color which contrasts with the background color.

Attaining this separation of the cursor from the background is easily accomplished when the display presents only a black and white output. The cursor need merely be described in black if the background is white and in white if the background is black. This may be done with a black and white monitor by assessing the color of the background using the single bit which controls that color, and inverting that bit to provide a color for the cursor opposite that background color.

However, for gray scale monitors and monitors capable of displaying twenty-four bit color pixels, many more shades or colors are available. These shades in the case of a gray scale display are typically designated by eight bits of information. These bits are capable of designating 256 individual shades of gray from white to black. In the case of twenty-four bit color information, eight bits are utilized to designate each of the shades of red, green, and blue which are combined to produce the final color of the pixel.

If, as is typical for a gray scale display, a byte of eight zeroes is used to designated black and a byte of eight ones to designate white, then a shade essentially half way between would be indicated by binary 0111 1111 and the next lighter shade would be indicated by binary 1000 0000. These shades are, of course, adjacent each other in a spectrum divided into 256 parts and hardly discernible from one another on a display. However, if each of the bits of the value representing either shade is inverted, the value for the other shade is produced. A similar result occurs with other shades close to the center of the gray scale spectrum. Consequently, the simple inversion of the binary values does not necessarily produce a pixel which contrast with and is readily discernible from the background.

A similar problem arises with twenty-four bit color pixels except that the results are much more complicated and the outcome more problematic. For each of the three red/green/blue color values which combine to provide the final pixel color, 256 possibilities exist. When the red component of the background is of a shade which is toward the middle of the red shading (e.g., 50% saturation), an inversion of the coding for that shade will produce a shade of red very similar to the background shade of red. Of course, this shade is combined with inverted shades of the other two colors to produce the final cursor color. With the great number of possibilities which exist for the final color, producing a color contrasting with the background color is a challenge. Sometimes a cursor will be discernible, sometimes it will not.

Figure 2:
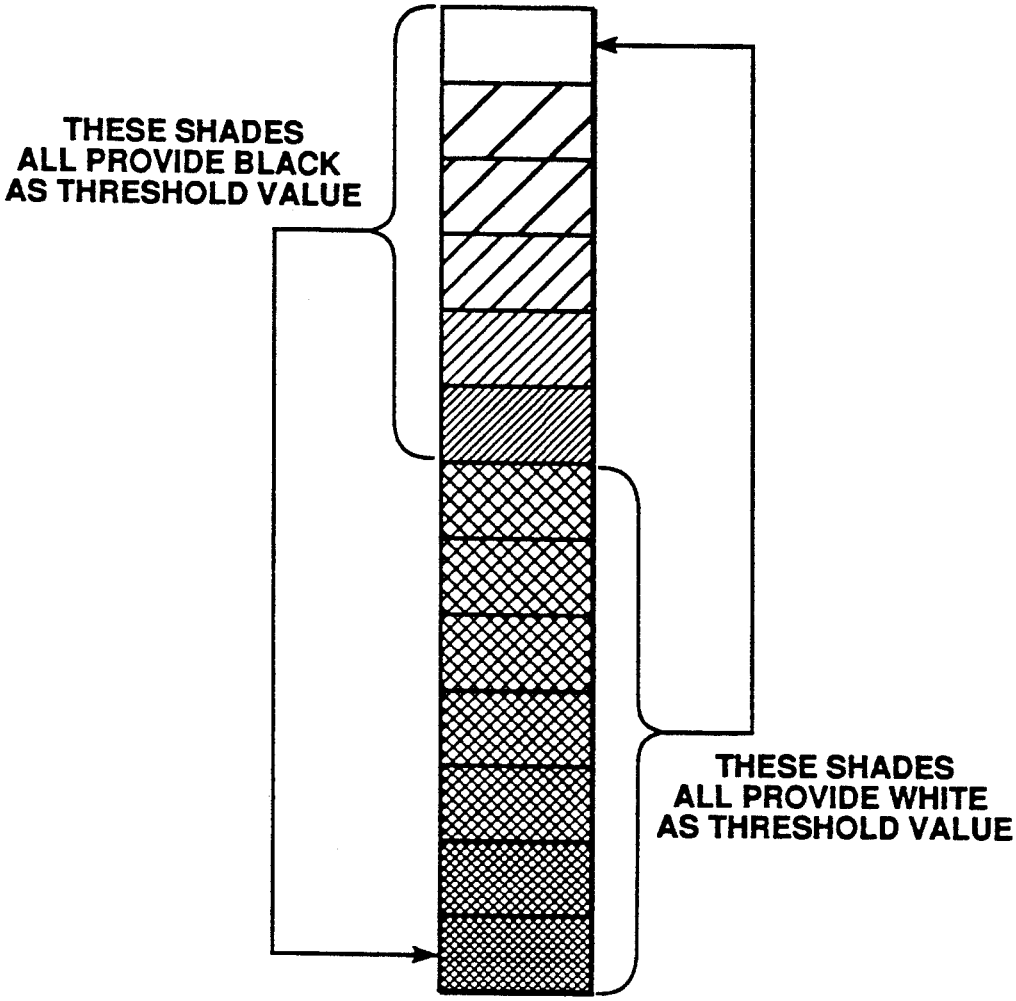
FIG. 2 is a diagram useful in understanding the invention which illustrates a number of color shades.

The present invention provides an arrangement by which a cursor or other overlay on a computer display will always be discernible no matter what shades of gray or color are involved. The present arrangement provides a thresholding function by which an overlay color is selected by ascertaining all of the components of the background shades and providing for each an overlay color which is at least one half of all the possible shades away from the background. For example, for any background gray scale shade between white and middle gray, an overlay shade of black is provided. For any background gray scale between black and middle gray, an overlay shade of white is provided. Thus, the gray scale shade of the overlay produced is guaranteed to be at least one half of the total scale of shades away from the background shade and readily discernible. FIG. 2 illustrates such an operation for a gray scale consisting of only twelve shades of gray. As may be seen in the diagram, each of the lighter shades when assessed produces a result which indicates that black is to be used as the contrasting shade. On the other hand, each of the darker shades when assessed produces a result which indicates that white is to be used as the contrasting shade.

For twenty-four bit color information, the same sort of an arrangement may be utilized. That is, the arrangement provides a thresholding function by which an overlay color is selected by ascertaining the background shade for each of the three colors separately and providing an overlay color for each which is at least one half of all the possible shades away from the background color of each. Thus, a background color made by combining a red shade less than the middle of the red shading, a green shade less than the middle of the green shading, and a blue shade greater than the middle of the blue shade, generates a final color (i.e., yellow) made by combining a saturated red with a saturated green with a blue of zero saturation level.

Figure 3:
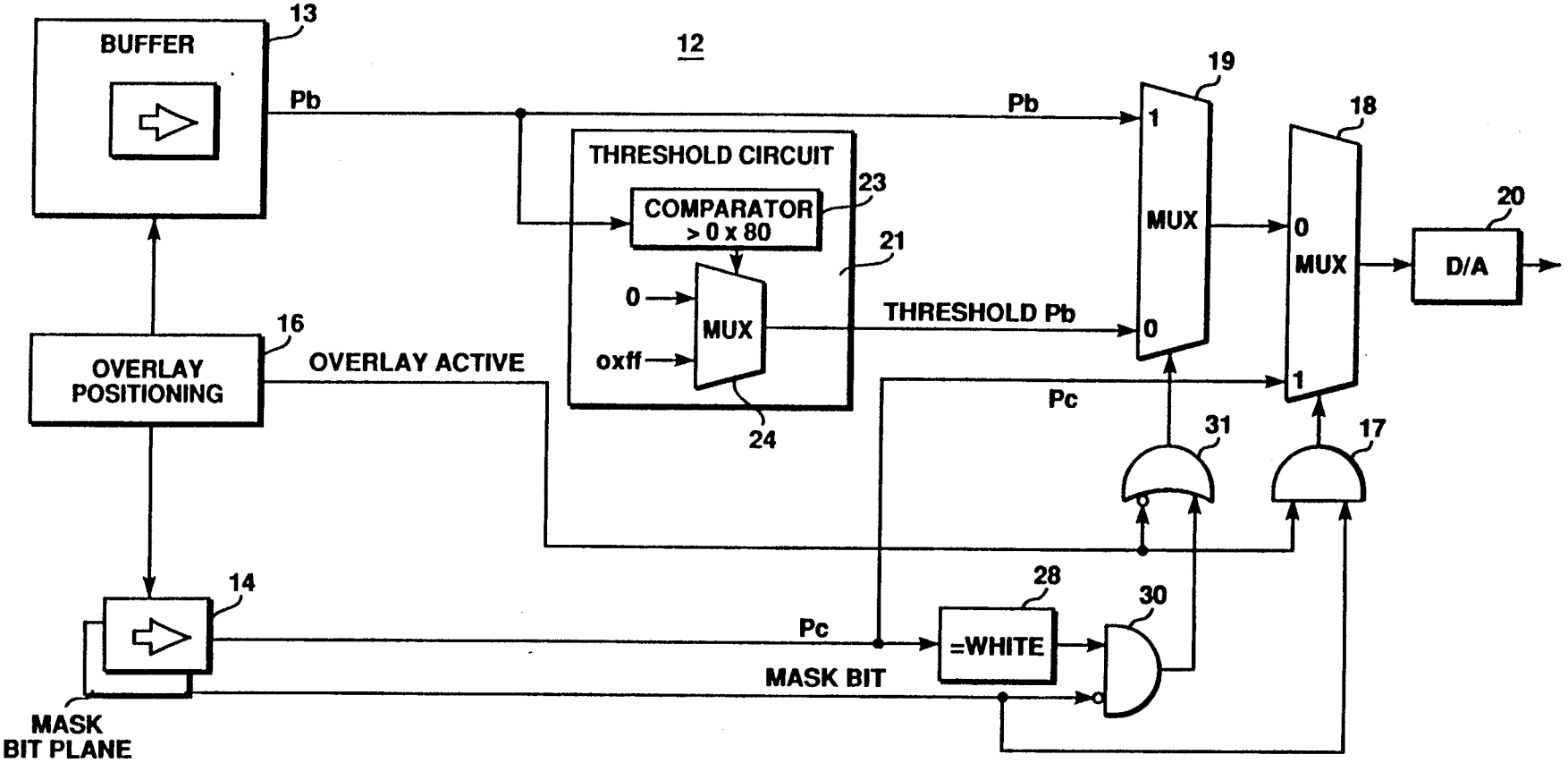
FIG. 3 illustrates a block diagram of a circuit in accordance with the present invention for producing readily discernible overlays on a computer output display.

FIG. 3 illustrates in block diagram a circuit 12 in accordance with the present invention for producing readily discernible overlays on a computer output display. The circuit 12 includes a frame buffer 13 in which are stored the pixel values to be displayed on a computer output display. Presuming that the display is a gray scale monitor, then eight bits of information regarding the shade of gray to be displayed are stored in the frame buffer 13 for each pixel to appear on the display. The circuit 12 also includes an overlay memory 14 for holding any overlay to be presented on the output display.

A circuit 16 is included for determining those positions of the display at which the overlay is to be presented during the display refresh operation. In accordance with the preferred embodiment of the invention, the circuit 16 may include registers for storing the horizontal and vertical positions at which the overlay which is to be superimposed on the output display starts and ends. The values in these registers may be compared to the position of the pixel on the scan line as the information in the frame buffer is scanned to the output display and used to determine the dimensions of the overlay region. At any position at which the overlay is to be superimposed on the background, an overlay active signal is produced which as is explained hereafter. The design of components and their interconnections to accomplish this positioning and to produce such an output signal are well known to those skilled in the prior art and are, for that reason, not described in detail in this specification. A circuit of this type for determining the position of an overlay on a background graphics display is illustrated in detail as a part of the description in U.S. patent application Ser. No. 07/957,345, entitled CIRCUITRY FOR PROVIDING AN OVERLAY FOR A COMPUTER OUTPUT DISPLAY, W. Dawson, et al., filed on even date herewith.

In FIG. 3, a particular cursor overlay pattern is illustrated as residing in the overlay memory 14, and the area of that particular cursor overlay is shown superimposed on the frame buffer 13 in order to assist in understanding the invention. As the display is refreshed line by line, at each position at which the background and the overlay rectangle coincide as determined by the circuit 16 and as signaled on the overlay active line, information regarding the overlay operation to be performed and the shade of the overlay is given. This information is produced by mask information stored for each position of the overlay in the overlay memory 14. In one embodiment of the invention, the mask bit for each pixel of the overlay provided in the memory 14 may be stored in a separate memory plane of the memory 14.

the mask information regarding the overlay operation defines whether the background pixel Pb from frame buffer 13, the overlay pixel Pc from memory 14, or a contrasting threshold value is to be produced. A single mask bit coupled with the shade of the overlay pixel may be used to provide the information. If the mask bit is in a first condition (asserted), it indicates that the overlay pixel Pc is to be produced as described by the overlay pixel data held in the memory 14. If the single mask bit is in a second condition (deasserted) and the overlay pixel is white, then the background color from the frame buffer 13 is produced; such a condition occurs in the overlay rectangle where the overlay is transparent to the background (where the cursor arrow is not present). If the single mask bit is in the second condition (deasserted) and the overlay pixel is any shade other than white, then the contrasting threshold value is produced.

In the circuit of FIG. 3, the pixel information Pc and the mask information at each pixel of the overlay are transferred from the memory 14. If a pixel is being refreshed which is within the overlay region on the display, the overlay active signal signalling that the overlay region is being traversed is provided by the overlay positioning circuit 16. This last signal is used to essentially enable the operation of the circuitry which accomplishes the positioning of the overlay on the display. Where it is desired that some portion of the overlay be of a particular shade, the mask bit is set to the first condition (asserted) so that the overlay pixel Pc is used to describe the pixel at the position. Thus, assuming the asserted condition of the mask bit is a one and that the overlay active signal has been received, the the mask bit is sent by an AND gate 17 to a multiplexor 18. The multiplexor 18 provides the cursor overlay value Pc to a digital-to-analog converter circuitry 20 for transfer to circuitry for producing the output display (not shown).

On the other hand, if the mask bit is a zero, the multiplexor 18 selects the value provided by a multiplexor 19 which may be either the background pixel Pb or the thresholded value of the background pixel. To provide the thresholded value of the background pixel, the background pixel value Pb is transferred to a threshold circuit 21. The threshold circuit 21 includes a comparator 23 which looks at the highest bit of the pixel value of the background pixel. If that bit is a one, it activates a multiplexor 24 to force all bits of the pixel to zero to produce a value indicating black. If that bit is a zero, it causes the multiplexor 24 to force all bits of the pixel value to ones thereby indicating white. The highest order bit of the gray scale information is thus used to select either a white pixel (1111 1111) or a black pixel (0000 0000). This maps all gray scale values darker than middle gray (1000 0000) to white and all gray scale values brighter than middle gray to black.

At any position at which it is desired to render the overlay transparent so that the background pixel is displayed, the cursor pixel Pc is stored as white and the mask bit is deasserted. A comparator circuit 28 receives the value of the cursor pixel Pc and signals that the overlay pixel is white. This signal with the zero value of the mask bit enables an AND gate 30. The AND gate 30 asserts a one value which is transferred by an OR gate 31 and controls the multiplexor 19 to transfer the value of the background pixel to the output display by way of the digital-to-analog converter circuitry 20.

If a thresholded value contrasting with the background pixel Pb is to be produced, then the cursor pixel may be any color other than white. The comparator 28 determines this and provides a value so that no signal is transferred by the AND gate 30. The OR gate 31 transfers an indication which causes the multiplexor 19 to transfer the thresholded background value via the multiplexor 18 to be used to describe the pixel at the position.

With a display presenting color information, the same operational control of each pixel is provided by control bits. However, the thresholding method described above is used to provide contrast instead of the prior art method of inverting the color values. In order to accomplish this, the threshold circuit 21 illustrated in FIG. 3 must be duplicated once for each of the three shades of color and a separate mask bit provided for each of the shades. Since each pixel is represented in the frame buffer by twenty-four bits of information, eights bits for each shade of red, green, and blue, each byte of the color information at each position at which it is desired to provide a contrasting overlay is compared to the threshold value to select the contrasting pixel value (1111 1111 or 0000 0000). The highest order bit is used to generate a new color shade which is either the completely saturated color or the absence of that color. For example, a red shade having a binary value of 0111 1111 or less (such as 0011 0111) has the zero in its highest bit inverted to a one and replicated to indicate a saturated red represented by the value 1111 1111; a red shade having a binary value of 1000 0000 or greater (e.g., 1010 0011) has the one inverted to a zero and replicated to indicate the absence of red represented by the value 0000 0000. In like manner, the green and blue values have their most significant bits inverted to generate green or its absence and blue or its absence, respectively.

It will be recognized that these six values combine to produce eight possible colors. White is produced from saturated red, saturated green, and saturated blue; black is produced from the absence of red, green, and blue; red is produced from saturated red; green is produced from saturated green, blue is produced from saturated blue; cyan is produced from saturated green and saturated blue; magenta is produced from saturated red and saturated blue; and yellow is produced from saturated red and saturated green. Although this drastically reduces the color complexity available for the overlay on an output display reducing the total number of colors to eight, it provides the most common colors (black and white) used for a cursor and guarantees contrast between the overlay and the background.

Figure 4:
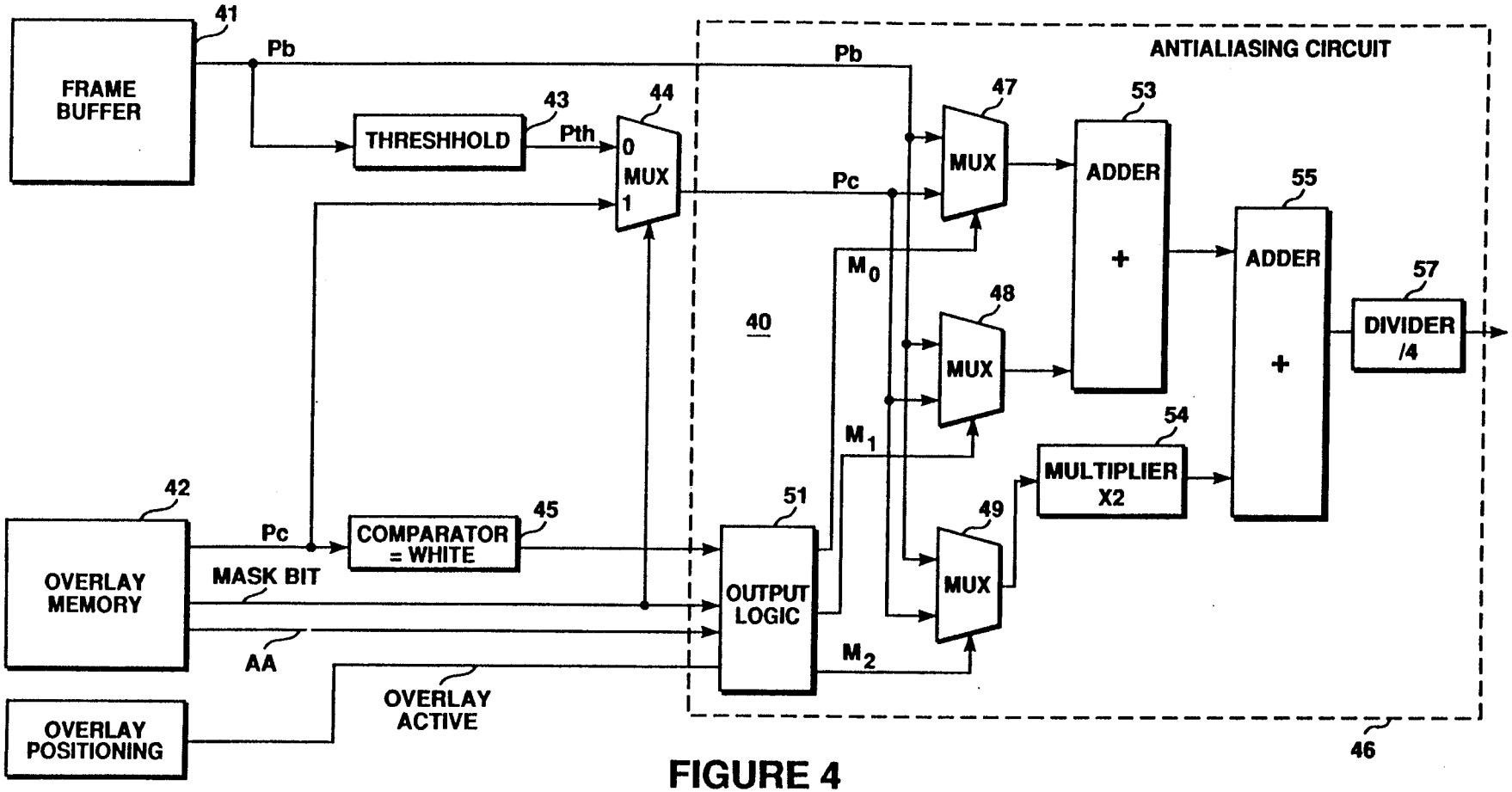
FIG. 4 illustrates a block diagram of another circuit in accordance with the present invention for producing readily discernible overlays on a computer output display.

An improved circuit 40 which provides a more advanced arrangement for generating overlay pixels is illustrated in FIG. 4. The circuit 40 includes circuitry which not only increases the contrast of an overlay with the background in order to produce a discernible overlay but also provides antialiasing of the lines of which the cursor (or other overlay or thresholded background values of those overlays) are described with the background pixel information. Antialiasing techniques are well known to those skilled in the art. These techniques, in general, involve arrangements for increasing and descreasing the intensity values of pixels in order to cause a line formed of those pixels to appear more smooth when viewed on an output display. Such techniques are applied in describing lines which run at a diagonal on a computer output display and, consequently, display the problems described as "jaggies." The actual techniques used are often to blend certain pixels at the outer edge of a line with the background against which the line lies by describing the particular pixel as a blend, or ratio, of the background pixel and the pixel describing the line. The details of the antialiasing techniques are well described by J. D. Foley and A. Van Dam in *Fundamentals of Interactive Computer Graphics*—First Edition, published by Addison-Wesley Publishing Co., pages 440–441. However, these techniques have not been applied heretofore to the describing of a cursor or an overlay but only to the background being displayed.

The arrangement of FIG. 4 includes a source of background pixels such as a frame buffer 41 and a source of overlay pixels such as an overlay memory 42. The pixels from the frame buffer 41 are furnished to a circuit 43 for providing a threshold operation as described above with relation to FIG. 3 in a manner to sense the shade of any particular or gray shade and provide an output which is at least half of all possible shades of that color away from the background shade. The threshold pixel values and the pixel values Pc designated for the overlay are furnished to a multiplexor 44 which is capable of choosing one or the other. The operation of the multiplexor 44 is controlled by the condition of the mask bit previously discussed. Both the background pixels Pb and the output of the multiplexor 44 are provided to an antialiasing circuit 46.

The antialiasing circuit 46 receives control inputs defining whether antialiasing is to occur and the particular operation involved. These include a signal from a comparator 45 which indicates that the value of the cursor is white or not white. They also include antialiasing bits AA which may be in addition to and part of the mask stored with the overlay pixel Pc at each byte of each pixel position. These antialiasing bits (two in the preferred embodiment) define four possible antialias values for each of the two different overlay bit possibilities. The antialiasing possibilities are illustrated in the column called destination pixel in the table of FIG. 5. They range from an opaque overlay pixel defined by the cursor pixel to a pixel which is one-quarter overlay pixel and three-quarters background pixel, or from an opaque pixel resulting from a background pixel thresholding operation (as described) to a pixel which is one-quarter thresholded background pixel and three-quarters background pixel. In reading the table of FIG. 5, if the raster scan is outside the overlay area, the overlay active bit is zero and a background pixel is produced. If the raster scan is within the area of the overlay, the overlay active bit is one and the arrangement furnishes the various chosen values for the overlay pixels. For example, when the overlay active bit is one, if the mask bit is zero and the value of the cursor pixel is not white and the antialiasing bits are 00, a pixel is produced which is one-quarter thresholded background pixel and three-quarter background pixel. The other values are reacted in a similar manner.

The choice of whether the antialias technique uses a thresholded value or a cursor pixel value depends on the single mask bit provided to the multiplexor 44. If the mask bit is a one, the multiplexor 44 transfers the value of the overlay pixel Pc to the antialiasing circuit 46. If the value is a zero, the multiplexor 44 transfers the value of the threshold background pixel Pth as described to the antialiasing circuit 46. It should be noted that the cursor pixel Pc and the threshold pixel Pth are both referred to as Pc' in FIG. 4 after the multiplexor 44. During the traversal of the overlay region, if the mask bit is a zero and the signal from the comparator 45 indicates a white overlay pixel value, then the background pixel Pb is furnished to the display. Otherwise, antialiasing occurs between the pixel cursor value Pc' and the background pixel Pb.

As may be seen in FIG. 4, the antialiasing circuit 46 receives the values transferred from the multiplexor 44 and the background pixel value and provides these values at the input to three multiplexors 47–49. The values furnished by the multiplexor 44 are always either thresholded values of the back ground pixel Pb or the cursor pixel Pc, shown in FIG. 4 as Pc'.

The white value of the cursor signal Pc, the mask bit value, the overlay active signal, and the antialias signal are each provided to logic circuitry 51 which provides output signals M0, M1 and M2 to operate the multiplexors 47–49. The multiplexors 47–49 will transfer values which are illustrated in the table of FIG. 5. Thus, if the mask bit is a zero, then the values referred to by Pc' transferred by the multiplexor 44 are the thresholded values Pth of the background pixel. Consequently, all values produced are combinations of the background pixel Pb and the threshold background pixel. For example, if the mask bit is a zero and the cursor pixel value Pc is white, the value of the background pixel Pb is transferred by each of the multiplexors 47–49. An adder 53 adds the results from the multiplexors 47 and 48 produce a value twice that of the background pixel Pb. A multiplier circuit 54 multiplies the value transferred by the multiplexor 49 to produce a value twice that of the background pixel Pb. These two values are added by an adder 55 and divided by four by a divider circuit 57 to produce an output equal to the value of the background pixel Pb.

On the other hand, if the mask bit is a zero and the value of the cursor pixel is not white, then the multiplexors 47–49 are controlled by the values of the antialias bits. For example, if the antialias bits are 00, the background pixel is provided to the multiplexors 47 and 49 and the threshold pixel is presented to the multiplexor 48. The background pixel Pb is added to the threshold value by the adder 53. This value is added to twice the value of the background pixel Pb produced by the multiplier 54. The result is divided by four by the divider circuit 57. This produces an output equal to three quarters of the background pixel and one quarter of the threshold pixel. Other values produced are as shown in the table of FIG. 5. It is aninteresting feature of the circuit that when the cursor pixel Pc is not utilized for the overlay, the condition of the cursor pixel as white or not white is used as a control to select among the different possibilities to be produced on the output display.

On the other hand, if the mask bit is a one, then the value of the cursor pixel Pc is transferred (as Pc') by the multiplexor 44. In such a case the values transferred by the multiplexors 47–49 are controlled by the value of the antialias bits in the same manner as discussed above except that Pc' equals the value of the cursor pixel Pc rather than the value of the thresholded background pixel Pth.

Thus, as has been demonstrated, the circuits of the present invention provide for a discernible overlay and one in which the overlay or a thresholded value of the background image may be treated by antialias techniques.

Although the present invention has been described in terms of a preferred embodiment, it will be appreciated that various modifications and alterations might be made by those skilled in the art without departing from the spirit and scope of the invention. The invention should therefore be measured in terms of the claims which follow.

What is claimed is:

1. A circuit for generating a value corresponding to a color for a pixel of a moveable overlay for a bitmapped output display, wherein the color of the pixel of the moveable overlay is distinguishable from a color of a background pixel, the circuit comprising:

means for selecting a threshold value corresponding to an approximate midpoint of a range of colors;

means for determining a background value corresponding to the background pixel color;

means for setting the pixel value of the moveable overlay to a minimum value if the background value is greater than the threshold value, wherein the background value remains unchanged and a difference between the minimum value and the background value corresponds to a contrast in the color of the pixel of the moveable cursor to the color of the background pixel; and means for setting the pixel value of the moveable overlay to a maximum value if the background value is less than the threshold value, wherein the background value remains unchanged and a difference between the maximum value and the background value corresponds to a contrast in the color of the pixel of the moveable cursor to the color of the background pixel;

means for setting the pixel value of the moveable overlay to either the maximum value or the minimum value if the background value is equal to the threshold value.

2. A circuit for generating a value corresponding to a color for a pixel of a moveable overlay for a bitmapped output display as claimed in claim 1 further comprising means for modifying the moveable overlay pixel value at any position to blend the moveable overlay pixel color with the background color.

3. A circuit for generating a value corresponding to a color for a pixel of a moveable overlay for a bitmapped output display as claimed in claim 2 in which the means for modifying the moveable overlay pixel value at any position to blend the moveable overlay pixel color with the background color includes means for combining background pixel values with overlay pixel values.

4. A circuit for generating a value corresponding to a color for a pixel of a moveable overlay for a bitmapped output display as claimed in claim 3 in which the means for combining background pixel values with overlay pixel values comprises multiplexor means for selecting background pixel values and overlay pixel values, and means for combining values selected by the multiplexor means.

5. A circuit for generating a value corresponding to a color for a pixel of a moveable overlay for a bitmapped output display as claimed in claim 2 in which the means for modifying the moveable overlay pixel value at any position to blend the moveable overlay pixel color with the background color includes means for combining background pixel values with thresholded background pixel values.

6. A circuit for generating a value corresponding to a color for a pixel of a moveable overlay for a bitmapped output display as claimed in claim 5 in which the means for combining background pixel values with thresholded background pixel values comprises multiplexor means for selecting background pixel values and thresholded background pixel values, and means for combining values selected by the multiplexor means.

7. A circuit for generating a value corresponding to a color for a pixel of a moveable overlay for a bitmapped output display as claimed in claim 1 further comprising means for determining for any particular position of the output display whether a background pixel or an overlay pixel is to be provided.

8. A circuit for generating a value corresponding to a color for a pixel of a moveable overlay for a bitmapped output display as claimed in claim 7 further comprising means for selecting at any position at which an overlay pixel is to be presented whether the moveable overlay pixel value has a thresholded overlay value, a background value, or a preselected overlay value.

9. A circuit for generating a value corresponding to a color for a pixel of a moveable overlay for a bitmapped output display as claimed in claim 8 further comprising means for modifying the overlay pixel value at any position to blend the overlay pixel with the background.

10. A circuit for generating a value corresponding to a color for a pixel of a moveable overlay for a bitmapped output display as claimed in claim 9 in which the means for modifying the overlay pixel value at any position to blend the overlay pixel with the background includes means for combining background pixel values with overlay pixel values.

11. A circuit for generating a value corresponding to a color for a pixel of a moveable overlay for a bitmapped output display as claimed in claim 10 in which the means for modifying the overlay pixel value at any position to blend the overlay pixel with background includes means for combining background pixel values with thresholded background pixel values.

12. A circuit for generating a value corresponding to a color for a pixel of a moveable overlay for a bitmapped output display as claimed in claim 7 in which the means for determining for any particular position of the output display whether a background pixel or an overlay pixel is to be provided includes an overlay frame buffer for storing overlay pixel information.

13. A circuit for generating a value corresponding to a color for a pixel of a moveable overlay for a bitmapped output display as claimed in claim 12 further comprising means for selecting at any position at which an overlay pixel is to be presented whether the overlay pixel has a thresholded overlay value, a background value, or a preselected overlay value.

14. A circuit for generating a value corresponding to a color for a pixel of a moveable overlay for a bitmapped output display as claimed in claim 13 in which the means for selecting at any position at which an overlay pixel is to be presented whether the pixel has a thresholded overlay value, a background value, or a preselected overlay value comprises means for storing masking values in the overlay frame buffer.

15. A circuit for generating a value corresponding to a color for a pixel of a moveable overlay for a bitmapped output display as claimed in claim 14 in which the means for storing masking values in the overlay frame buffer includes a mask bit and information indicating a color value.

16. A circuit for generating a value corresponding to a color for a pixel of a moveable overlay for a bitmapped output display as claimed in claim 15 further comprising means for modifying the overlay pixel value at any position to blend the overlay pixel with the background.

17. A circuit for generating a value corresponding to a color for a pixel of a moveable overlay for a bitmapped output display as claimed in claim 16 in which the means for modifying the overlay pixel value at any position to blend the overlay pixel with the background includes means for combining background pixel values with overlay pixel values.

18. A circuit for generating a value corresponding to a color for a pixel of a moveable overlay for a bitmapped output display as claimed in claim 17 in which the means for combining background pixel values with overlay pixel values comprises multiplexor means for selecting background pixel values and overlay pixel values, and means for combining values selected by the multiplexor means.

19. A circuit for generating a value corresponding to a color for a pixel of a moveable overlay for a bitmapped output display as claimed in claim 18 in which the means for modifying the overlay pixel value at any position to blend the overlay pixel with the background includes means for combining background pixel values with thresholded overlay pixel values.

20. A circuit for generating a value corresponding to a color for a pixel of a moveable overlay for a bitmapped output display as claimed in claim 19 in which the means for combining background pixel values with thresholded background pixel values comprises multiplexor means for selecting background pixel values and thresholded background pixel values, and means for combining value selected by the multiplexor means.

21. In a computer graphics system, an apparatus for generating a value corresponding to a shade of a pixel of a moveable overlay for a bitmapped output display, wherein the pixel of the moveable overlay is distinguishable from a background pixel, the apparatus comprising:

means for determining a background value corresponding to a shade of the background pixel;

means for setting the value of the pixel of the moveable overlay to a first value if the background value is greater than a preselected value, wherein the background value is not changed and a difference between the first value and the preselected value corresponds to a contrast in the shade of the pixel of the moveable overlay relative to the shade of the background pixel; and means for setting the value of the pixel of the moveable overlay to a second value if the background pixel value is less than the preselected value; wherein the background pixel value is not changed and a difference between the second value and the preselected value corresponds to a contrast in the shade of the pixel of the moveable overlay relative to the shade of the background pixel.

* * * * *